United States Patent [19]

Fresow et al.

[11] 4,212,280

[45] Jul. 15, 1980

[54] IGNITION SYSTEM FOR INTERNAL COMBUSTION ENGINES

[75] Inventors: Jürgen Fresow, Schwieberdingen; Bert Wurst, Möglingen, both of Fed. Rep. of Germany

[73] Assignee: Robert Bosch GmbH, Stuttgart, Fed. Rep. of Germany

[21] Appl. No.: 865,577

[22] Filed: Dec. 29, 1977

[30] Foreign Application Priority Data

Jan. 8, 1977 [DE] Fed. Rep. of Germany ..... 2700676

[51] Int. Cl.[2] ..... F02P 1/00

[52] U.S. Cl. ..... 123/611

[58] Field of Search ..... 123/148 E

[56] References Cited

U.S. PATENT DOCUMENTS

| | | | |
|---|---|---|---|
| 3,550,571 | 12/1970 | Mainprize | 123/148 E |
| 3,874,355 | 4/1975 | Suda | 123/148 E |
| 3,989,024 | 11/1976 | Lai | 123/148 E |
| 4,019,484 | 4/1977 | Mori | 123/148 E |
| 4,043,302 | 8/1977 | Sessions | 123/148 E |
| 4,044,733 | 8/1977 | Suda | 123/148 E |
| 4,057,740 | 11/1977 | Arguello | 123/148 E |
| 4,064,859 | 12/1977 | Kashiwazaki | 123/148 E |
| 4,082,075 | 4/1978 | Davis | 123/148 E |
| 4,086,895 | 5/1978 | Habert | 123/148 E |

*Primary Examiner*—Ronald B. Cox

*Attorney, Agent, or Firm*—Frishauf, Holtz, Goodman & Woodward

[57] ABSTRACT

The ignition coil of the system has its primary serially connected with a transistor which controls current flow therethrough. Ignition pulses are provided by an ignition pulse source, for example an inductive transducer. The recurrence rate of the ignition pulses is analyzed and a corresponding control signal is obtained which controls the timing interval of a timing circuit, the timing circuit determining the ON, or connected time, of the transistor or similar controlled switch in series with the primary of the ignition coil. Analysis of the recurrence rate is, simply, done in a pair of integrators, alternately effective and storing the time interval between alternate, succeeding ignition pulses, which permits control of current flow through the ignition coil for a period of time just sufficient for current flow to reach saturation without, however, causing current flow while the circuit is saturated, thus preventing unnecessary heating of the ignition coil and associated components.

Alternate integration of alternate signals permits efficient operation also under high-speed operating conditions.

8 Claims, 2 Drawing Figures

IGNITION SYSTEM FOR INTERNAL COMBUSTION ENGINES

Cross reference to related application, assigned to the assignee of the present application U.S. Ser. No. 865,578, filed Dec. 29, 1977, Sohner et al.

The present invention relates to an ignition system for an internal combustion engine, and more particularly to a solid-state, transistor-controlled ignition system in which the ignition coil and associated components are operated at maximum efficiency.

BACKGROUND AND PRIOR ART

The dwell angle, or dwell time, that is, the ON, or closed period of a switch, serially connected with the primary of the ignition coil, should preferably be controlled as a function of speed so that, under low-speed conditions, current will not flow through the ignition coil for an excessively long period of time. Ignition systems with speed-dependent ON-time of a controlled switch, in series with the ignition coil, have previously been proposed—see German Disclosure Document DT-OS 22 44 781. This system, as described, has the disadvantage that the transducer which provides the trigger signals to control the switch in series with the ignition coil must be accurately constructed and must provide output pulses of essentially uniform ON/OFF ratio. Construction of angle transducers providing output signals accurately allocated to angular positions of the crankshaft of the engine is expensive.

THE INVENTION

It is an object to provide an ignition system which can operate with simple transducer elements, and essentially with transducers which provide pulses only for the timing of the ignition event, that is, for interruption of current flow, while control of the ON-time is obtained by speed-dependent signal processing.

Briefly, pulses derived from a pulse transducer are analyzed with respect to their recurrence rate and a corresponding control signal is obtained which is connected to control a timing circuit, the timing circuit determining the connection, or ON-time of the controlled switch in series with the primary of the ignition coil, so that the time duration of current flow through the primary of the ignition coil will be essentially uniform.

In accordance with a feature of the invention, a time period between succeeding ignition pulses is analyzed by controlling an integrator thereby, the integrated value then controlling the timing period of the timing circuit. Preferably, two integrators are provided, the integrated values then being stored, the integrators operating alternatingly to provide rapid response to changes in speed and high-speed operation.

Drawings, illustrating an example

Figure 1:
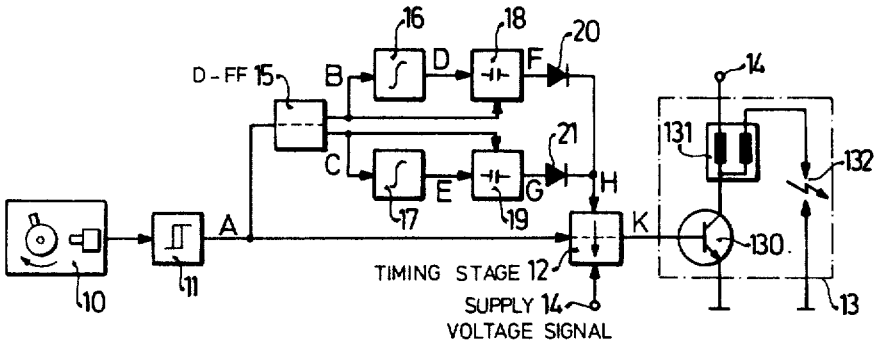
Figure 2:
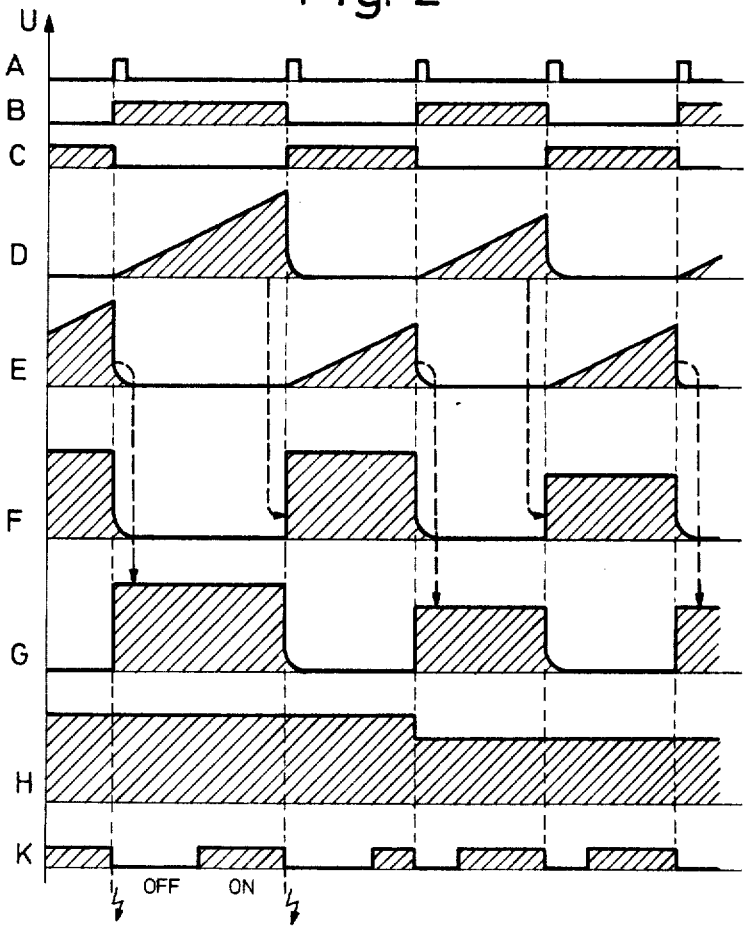

FIG. 1 is a schematic block diagram illustrating the system of the present invention; and FIG. 2 is a series of timing diagrams illustrating signals arising in the system of FIG. 1, in which the lettered graphs have been given the same letter identification as similar signals in FIG. 1.

The crankshaft of an internal combustion engine (not shown), for example an automotive internal combustion engine, is connected to a rotating portion of a transducer 10. Transducer 10 has its output connected to a wave-shaper 11, for example a Schmitt trigger. As illustrated, transducer 10 is an inductive transducer; other types of transducers may be used, for example a breaker-type terminal, a Hall transducer, or any other magnetic or optical transducer. The output of the wave-shaping stage 11 is connected to a timing stage 12 which controls the ignition circuit 13. The ignition circuit 13 is a solid-state, typically transistorized, unit having a controlled switch 130, shown schematically as a transistor; driver transistors, and the power unit itself in the form of a Darlington circuit may be used, depending on current requirements. The emitter of transistor 130 is connected to a reference of chassis terminal, the collector to the primary of ignition coil 131, the other terminal of which is connected to a source of power supply, typically the positive terminal of the battery of an automotive vehicle. The junction between the power transistor 130 and the primary of ignition coil 131 is connected to the secondary which, in turn, is connected to a spark gap 132, typically a spark plug. A distributor, as well known, can be interposed between the secondary and a multiplicity of spark plugs when the system is used with multi-cylinder internal combustion engines. The timing of the timing stage 12 is variable and depends on the recurrence rate of the signals delivered by the transducer 10. The timing of timing stage 12 is controlled as follows: The output of wave-shaping stage 11 from transducer 10 is additionally connected to a flip-flop (FF) 15, preferably a D-FF. The D-FF has complementary outputs. Each one of the outputs from the D-FF is connected to a respective integrator 16, 17, the output of which is connected to a respective memory or storage stage 18, 19. The memory may be a charge capacitor, as schematically indicated in the blocks 18, 19. The outputs of the memories 18, 19 are connected over respective decoupling diodes 20, 21 forming an OR-gate to the timing control input of timing stage 12. The timing state 12, preferably (but not necessarily) has another timing control input which is connected to the positive terminal of the battery, that is, terminal 14, to have a signal applied thereto representative of the voltage level of the voltage supply to the ignition system, to additionally modify or control the timing interval of the stage 12. Stage 12, preferably, is a monostable multivibrator (MMV) having an unstable period which determines its timing interval.

Operation, with reference to FIG. 2: The signal from transducer 10, as wave-shaped in stage 11, is a square wave signal A. This square wave signal can have any desired form since only one of its two flanks—in the example illustrated the leading flank—is used to control the entire circuit. The leading flank of the signal A triggers the timing circuit 12 so that it changes to unstable state, that is, the output signal K changes from a 1-signal level to a 0-signal level. Additionally, the leading flank triggers the ignition event since change of the output signal from the timing stage 12 will cause transistor 130 to block, suddenly interrupting through ignition coil 131 and causing arc-over at the respective spark plug. The ignition event is schematically shown in FIG. 2 by the lightning arrow.

The unstable time, or the timing interval of the stage 12 is identical to the open or OFF-time of the power transistor 130 in the transistorized ignition system. The commencement of this OFF-time, that is, the rising flank of the signal A, also triggered ignition. After the unstable time, that is, the timing interval of circuit 12, has terminated, the ON-signal from timing stage 12 will gate transistor 130 to become conductive. Current will begin to flow from source 14 through the ignition coil 131 and the transistor 130. This current will rise gradually through the coil 131. The ON-time of the transistor 130 should extend for such a period that the current rises to just its saturation value, but not completely to saturation, so that the $I^2R$ losses in the ignition system will be as low as possible, thus reducing the thermal load on the ignition coil and on the solid-state elements of the ignition system, typically the power stage, here transistor 130.

As the speed of the engine increases, the ON-time or closed time of the power stage 130 will become shorter and shorter, thus providing insufficient current flow through the ignition coil 131, and thus insufficient storage of magnetic energy therein and insufficient ignition energy to the spark gap 132. In order to prevent this, the circuit components 15–21 modify the timing interval of the timing stage 12 in such a manner that the unstable time of the timing stage 12, that is, the open or OFF-time of transistor 130, becomes shortened with respect to the ON-time. As a result, the ON-time of the transistor 130 will remain essentially constant, at least over a number of cycles. This decrease in ON-time has a certain limit, since a predetermined minimum open or OFF-time must remain in order to permit discharge of the ignition coil 131 through the spark gap 132, that is, a spark of sufficient energy and duration.

The speed-dependent output signal controlling the ON-time of timing stage 12 is obtained by integration of the timing interval of sequential pulses from the generator 10. The FF 15 changes state upon each pulse derived from the generator 10. The complementary outputs of FF 15, thus, provide the output signals B and C (FIG. 2). During the signal B, integrator 16 integrates, see graph B; during the signal C, integrator 17 integrates, resulting in the signal E. At the termination of the respective signals B and C, the integrated value is stored in the memory, or storage stages 18, 19, respectively. This is schematically indicated by the broken lines in FIG. 2. Simultaneously, the respective indicator 16, 17 is reset. The respective stored values of the integrated signals in the memories 18, 19 are shown in graphs F and G. The respective memories 18, 19 are reset at the beginning of the next signal B, or C, respectively, for example by connecting the respective storage capacitor in the circuits 18, 19 to a rapid discharge circuit through a triggered semiconductor switch, controlled by respective connections from D-FF 15, as shown in FIG. 1. The junction of the diodes 20, 21 then will have the added signals from the two memories 18, 19 appear, forming the signal H, which controls the timing of the timing stage 12, and hence the commencement or ON-time of the signal sequence K.

Under some conditions, the OFF-time of the timing stage 12 and the subsequent controlled ignition event may leave only a shorter ON or connected time for the switch than would normally be desirable, as indicated with respect to the third pulse of graph K. This decrease of ON-time would only occur as a transient situation and is exaggerated in the figure for purposes of illustration, occurring actually in much less drastic manner due to the mechanical inertia of the engine, and the drive train to which it is connected. In any event, the overall operation of the engine is not thereby effected, and a new level of shorter OFF-time and again normal ON-time of the switch 130 will rapidly reestablish itself, see the fourth and fifth pulses, line K.

Terminal 14 can provide for additional control of the OFF-time of the switch 130, under control of the timing stage 12, by additionally controlling the unstable timing interval thereof as a function of the voltage level of the supply voltage from terminal 14. This has the advantage that, upon dropping supply voltage, the OFF-time of the timing stage 12 can be further decreased so that the overall energy supplied to the ignition system 13 will be substantially constant, by increasing the ON-time of the power transistor forming the controlled switch 130. Thus, even if the supply voltage should drop, the current through the ignition coil will remain essentially constant. This is particularly important upon starting of an internal combustion engine. During starter operation, the battery voltage frequently drops. Although the battery supplies high starter current, at a lower voltage, still, sufficient ignition energy is provided, thus resulting in rapid starting.

Voltage controlled timing stages are well known and available in many forms. Monostable multivibrators are suitable. In one embodiment, for example, a timing circuit is connected to controlled charge or discharge current networks, in which the controlled current networks are voltage controlled, or otherwise controllable by a control signal. Voltage controlled unstable time of timing circuits can also be obtained by connecting a suitable voltage representative of the control voltage to the emitter of a threshold transistor in a monostable multivibrator, for example by connecting the emitter to the tap point of the voltage divider which is supplied by the command voltage.

The circuit of FIG. 1 can be simplified by using only a single channel including an integrator and a memory. If this embodiment is used, then the stored value in the memory must be maintained until the integrator has been reset and has integrated during a subsequent cycle to provide modification of the previously stored value. The memory will then reflect the integrated value during any preceding integrating cycle.

Various changes and modifications may be made. For example, the two integrating-memory channels 16–18; 17–19 can be controlled not by an FF, but by directly connecting one integrator-memory channel to the output of the transducer 10, the other channel being connected to the output of the transducer 10 through an inverter. If this system is used, then the transducer 10 preferably provides output signals having a duty cycle, or an ON/OFF ratio of 1:1.

The system permits use of simple and effective transducers to provide the ignition pulse, and specifically transducers of any desired construction which provides an ignition pulse characterizing, essentially, only the ignition instant when the ignition spark is to occur. The particular wave shape which is used to trigger this ignition event is not critical. The ignition event, thus, can be triggered by any desired system, be it simple, or be it complex and controlled, for example, by an ignition computing system which considers various parameters affecting the ignition instant. Current flow through the ignition coil, however, is reduced since only that heating will occur which is due to resistance losses while current is required to flow, that is, while current is required to store magnetic energy in the ignition coil. The system can thus be designed for current flow through the primary of the ignition coil which terminates when saturation is reached, or is just about to be reached, thereby reducing the heating of the ignition coil to a minimum, permitting use of ignition coils of lighter construction and hence a less expensive coil structure. Additionally, the semiconductor switch 130 is less loaded and less subject to heating.

Alternate operation of the integrator channels 16, 18; 17, 19 also permits use of less complex and less expensive components which can easily be reset by simple control signals not requiring highly accurate or high-speed circuitry.

Various other changes and modifications may be made within the scope of the inventive concept.

We claim:

1. Ignition system for an internal combustion engine having an ignition coil (131);

a controlled switch (130) serially connected with the primary of the ignition coil (131) and controlling the commencement and interruption of current flow therethrough;

a control signal source (10, 11) coupled for rotation with the engine and providing ignition control pulses to determine the opening instant of said controlled switch (130) and hence determining the ignition instant of said system;

a timing circuit (12) connected to and controlling the time instant of connection of the controlled switch (130) for said current flow therethrough and through the ignition coil;

connection timing control means (16, 18, 20; 17, 19, 21) responsive to the recurrence rate of ignition pulses providing a control signal representative of said recurrence rate, and hence speed of the engine, connected to and controlling the timing circuit (12) to thereby control the time instant of connection of the controlled switch (130) subsequent to a prior opening thereof as a function of engine speed including an integrator means (16, 17) integrating during the time of subsequent recurrent ignition pulses, and providing said control signal as a function of the integration time to said timing circuit, the timing circuit commanding closing after a prior opening at time instants which variably follow said prior opening as the recurrence rate of said ignition pulses changes, to maintain the closed or ON-time of said controlled switch (130) essentially constant as the speed of the engine varies;

and further including a memory means connected to the integrator means and storing a signal representative of the integrated value integrated by said integrator means over the time between successive pulses, the memory being connected to said timing circuit to control timing interval thereof.

2. System according to claim 1, further including a bistable circuit (15) connected to and controlled by said control signal source (10, 11) and having complementary outputs;

and wherein said integrator means includes a pair of integrators, each respectively connected to the outputs of said bistable circuit, and each alternatingly integrating during pulses from said bistable circuit, as the bistable circuit changes state under command of the signals from said control signal source (10, 11), the outputs from said integrators being combined to form said control signal controlling the timing circuit.

3. System according to claim 2, wherein the memory means includes a pair of memory stages (18, 19), one, each, being connected to a respective integrator (16, 17) of the pair, the memory stages storing signals representative of the integrated output from said integrators, and providing said control signal to said timing circuit (12).

4. System according to claim 1, further including a source of current supply (14) of changeable voltage level, connected to said ignition coil (131), and providing current flow therethrough;

said source being additionally connected to said timing circuit (12) to additionally control the timing interval thereof as a function of the level of supply voltage to increase the time during which current flow through said ignition coil (131) is permitted under command of said controlled switch (130) if the voltage level of said source drops.

5. System according to claim 2, further including a source of current supply (14) of changeable voltage level connected to said ignition coil (131) and providing current flow therethrough;

said source being additionally connected to said timing circuit (12) to additionally control the timing interval thereof as a function of the level of supply voltage to increase the time during which current flow through said ignition coil (131) is permitted under command of said controlled switch (130) if the voltage level of said source drops.

6. System according to claim 1, wherein the integrator means includes a pair of integrators (16, 17), said integrators providing said control signal to said timing circuit (12);

and signal processing means (15) connected to and controlled by said control signal source (10, 11) sequentially, alternatingly, connecting respective ones of said integrators to integrate during the time period of successive, sequential pulses.

7. System according to claim 6, wherein said signal processing means includes means connecting one of the integrators to be controlled by the output from the control signal source and to control the other integrator of the pair to be connected by an inverted signal derived from said control signal source (10, 11).

8. System according to claim 7, including a direct connection means from said control signal source (10, 11) to one of the integrators (16), and a connection means including an inverter from said control signal source (10, 11) to the other integrator (17).

* * * * *